United States Patent [19]

Orr

[11] 4,317,557

[45] Mar. 2, 1982

[54] EMERGENCY BLOWOUT PREVENTER (BOP) CLOSING SYSTEM

[75] Inventor: Willis P. Orr, Lafayette, La.

[73] Assignee: Exxon Production Research Company, Houston, Tex.

[21] Appl. No.: 57,462

[22] Filed: Jul. 13, 1979

[51] Int. Cl.[3] ..... E21B 33/06; F15B 13/04

[52] U.S. Cl. ..... 251/1 B; 251/1 A; 91/33

[58] Field of Search ..... 251/1 R, 1 B, 1 A, 26; 91/6, 28, 32, 33, 454, 456; 166/84

[56] References Cited

U.S. PATENT DOCUMENTS

| | | | |
|---|---|---|---|
| 2,300,694 | 11/1942 | Overbeke | 91/33 |
| 2,618,243 | 11/1952 | Treganowan | 91/33 |
| 3,044,481 | 7/1962 | Regan | 251/1 R |
| 3,075,737 | 1/1963 | Cartalupo et al. | 251/26 |
| 3,091,256 | 5/1963 | Becker | 91/32 |
| 3,225,831 | 12/1965 | Knox | 251/1 B |
| 3,530,891 | 9/1970 | Walland et al. | 251/26 |
| 3,695,349 | 10/1972 | Murman et al. | 251/1 B |
| 3,750,694 | 8/1973 | Fawkes | 251/26 |
| 3,782,250 | 1/1974 | Kiszewski | 91/454 X |
| 3,827,668 | 8/1974 | DeVries et al. | 251/26 |
| 4,065,094 | 12/1977 | Adams | 251/26 |
| 4,071,085 | 1/1978 | Grable et al. | 166/84 |

*Primary Examiner*—A. Michael Chambers
*Attorney, Agent, or Firm*—John S. Schneider

[57] ABSTRACT

A blowout preventer control system for use in well operations includes a BOP having at least one opening chamber and at least one closing chamber, and an operating power fluid source connected to the BOP opening and closing chambers by an opening conduit and a closing conduit, respectively. A valve controlled conduit is connected to the opening conduit to ensure drainage of power fluid from the opening chamber of the BOP. A three-way shuttle valve is connected into the closing conduit close to the BOP. The shuttle valve is provided with an inlet which is connected to the closing conduit and another inlet which is connected by a conduit to an independent BOP operating power fluid source. An outlet of the shuttle valve is connected to the closing chamber of the BOP.

1 Claim, 4 Drawing Figures

EMERGENCY BLOWOUT PREVENTER (BOP) CLOSING SYSTEM

BACKGROUND OF THE INVENTION

1. Field of the Invention

This invention concerns control systems for operating blowout preventers used in well drilling operations for closing off around drill pipe and the like extending through the blowout preventer bore or for closing the blowout preventer bore itself if no pipe extends through it. More specifically, it pertains to an improvement which provides an emergency closing system connected into a conventional blowout preventer control system and which can be operated to close the blowout preventer should the control system malfunction and not operate.

2. Description of the Prior Art

Conventional blowout preventer control systems include an operating power fluid supply unit for opening and closing the blowout preventer. It is usually remotely located from the drilling rig floor. The operating power fluid is conveyed from the supply unit through an opening conduit and a closing conduit to the opening and closing chambers, respectively, of the blowout preventer. The blowout preventer is normally in the open position during drilling operations and is closed when a blowout is suspected or occurs. Should it become necessary to close the blowout preventer and the conventional control system malfunctions, no independent means are provided to supply operating power fluid to close the blowout preventer. Some systems provide alternate means for routing fluid to the blowout preventer but all are dependent on a common, not independent, operating power fluid supply source. There is a need for an emergency power fluid system to ensure closing of the blowout preventer which is connected into the conventional blowout preventer control system, is capable of being operated quickly, and has its own operating fluid supply source which is completely independent of the power fluid supply source of the conventional system. The independent operating fluid supply and valves for controlling the flow thereof into and from the conventional system are preferably located remote from the drilling rig floor to permit accessibility in case of fire or other dangerous conditions on or near the rig floor during a sudden blowout.

SUMMARY OF THE INVENTION

This invention concerns an independent blowout preventer closing system adapted to be connected into a conventional blowout preventer control system whereby the blowout preventer may be closed should a malfunction occur in the operation of the conventional control system. A conventional BOP control system includes an operating power fluid supply for supplying power fluid to the opening and closing chambers of the BOP to operate the BOP and an opening conduit and a closing conduit connecting the power fluid supply to the opening and closing chambers, respectively. The improvement provided by the invention includes a valve controlled drain conduit connected into the opening conduit and a three-way valve having spaced-apart inlet ports and an outlet port and connected into the closing conduit preferably close to the blowout preventer. The three-way valve is connected by one of its inlet ports to the closing conduit and by its outlet port to the closing chamber of the blowout preventer. The other inlet of the three-way valve is connected by an emergency power fluid conduit to a BOP operating power fluid source independent of the BOP operating power fluid supply of the conventional system. Valves are arranged in the emergency power fluid conduit to control flow of fluid therethrough.

DESCRIPTION OF THE PREFERRED EMBODIMENTS

Figures 1, 2:
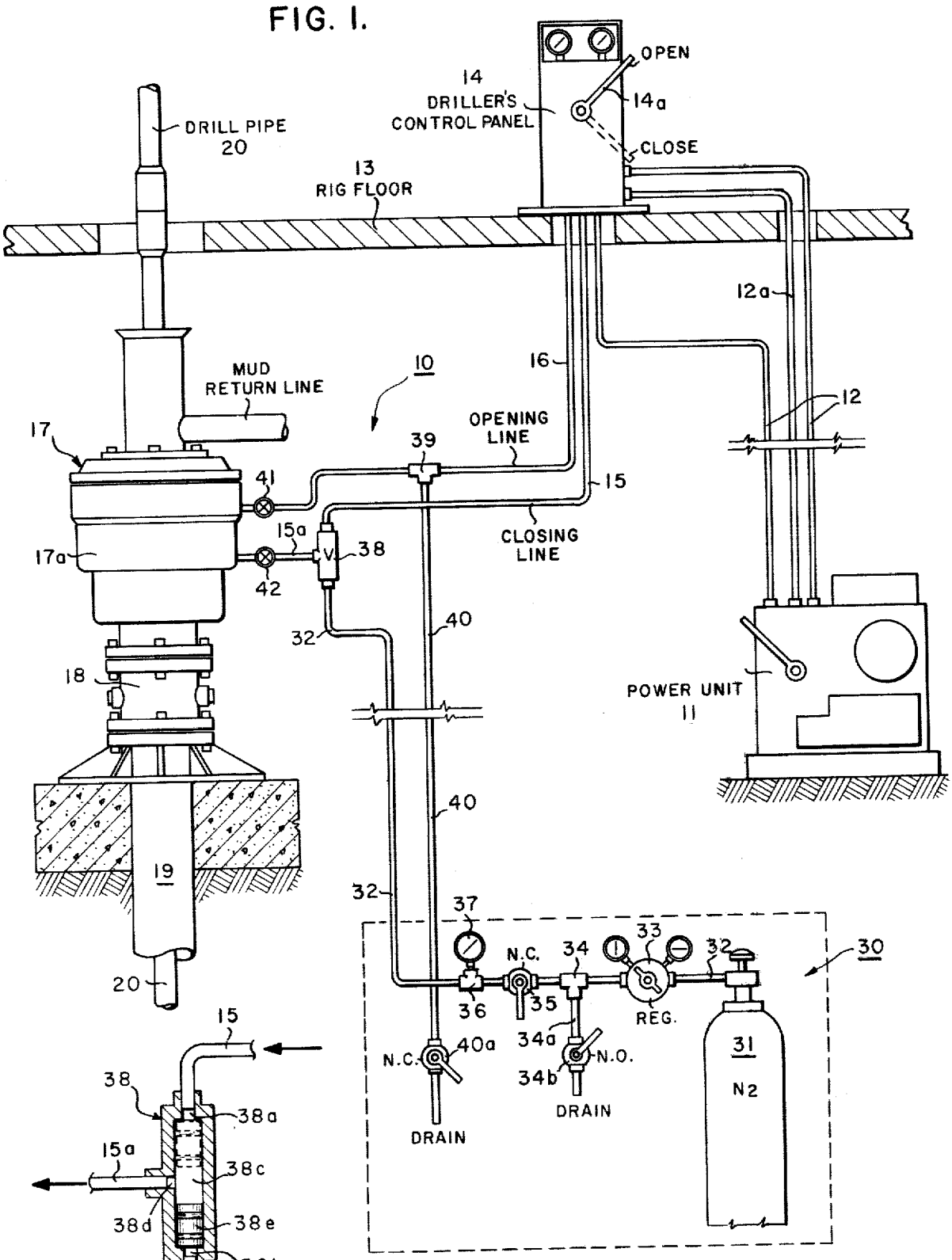
FIG. 1 is a schematic illustration of a conventional blowout preventer control system incorporating the emergency-independent closing system of the present invention.
FIG. 2 is a fragmentary view partly in section of a shuttle valve used in the closing system.
Figure 3:
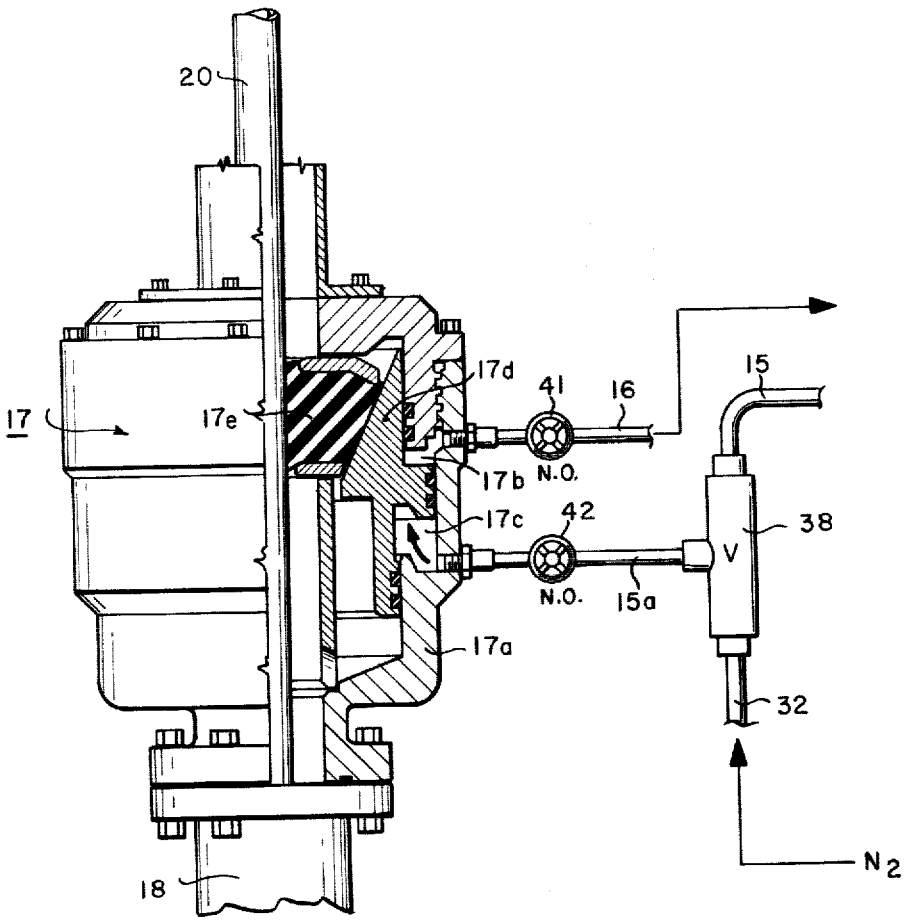
FIG. 3 is an enlarged view, partly in section, of the structure of the annular-type blowout preventer of FIG. 1.

Referring to FIGS. 1, 2 and 3, numeral 10 generally designates a conventional blowout preventer control system incorporating the emergency blowout preventer closing system of the present invention. The conventional system includes a BOP power fluid supply unit 11 which supplies operating fluid by way of conduits 12 to a driller's control panel 14 which is operated by a control arm **14*a* and is located conveniently on a drilling rig floor 13. Control conduit 12*a* is operated by control arm 14*a*. Operating power fluid from panel 14 is directed either through a conduit 15 to close a blowout preventer 17 or through a conduit 16 to open the blowout preventer (or conduits 12 may be directly connected to conduits 15 and 16). Blowout preventer 17 is connected to a wellhead 18 which in turn is connected to the upper end of a well casing 19. As shown, a drill pipe string 20 extends through the blowout preventer 17 and into a well casing 19. Normally, the closing conduit 15 and opening conduit 16, provided with normally open manual valves 42 and 41, respectively, are connected directly into the housing 17*a* of blowout preventer 17 and the blowout preventer is normally operated by the control panel arm 14*a* to the open or closed position. Should an emergency occur and the control panel or the remote power unit malfunction and fail to operate, no means are provided to close the blowout preventer about the pipe string 20**.

The present invention provides an independent emergency blowout preventer closing system which is connected into the conduits 15 and 16 in proximity to the preventer 17.

The independent closing control system includes an operating fluid pressure source such as a nitrogen bottle 31, the outlet of which is connected to one end of a conduit 32. The other end of conduit 32 is connected to a three-way shuttle valve 38. Arranged in sequence in conduit 32 from source 31 is a pressure regulator 33 for controlling pressure to be released into conduit 32, tee connection 34, manually operated valve 35 for controlling flow of fluid through conduit 32 and a tee connection 36 having a pressure gauge 37 for indicating the pressure in conduit 32 connected thereto. Connection 34 connects conduit 32 to a drain conduit **34*a* controlled by a manually operated valve 34*b*. A tee connection 39 arranged in opening conduit 16, connects conduit 16 to a drain conduit 40, the flow through which is controlled by a manually operated valve 40***a*. Nitrogen bottle 31, regulator 33, valve 34*b*, valve 35, pressure gauge 37 and drain valve 40*a* may be grouped together as indicated by numeral 30 preferably in a location remote from the rig floor.

Referring to FIGS. 2 and 3, shuttle valve 38 contains an inlet port 38*a* which communicates with valve bore 38*c* and is connected to closing conduit 15, and another inlet port 38*b* which also communicates with valve bore 38*c* is connected to conduit 32. An outlet port 38*d* also communicates with bore 38*c* and is shown located midway in the valve housing between inlet ports 38*a* and 38*b*. A shuttle valve member 38*e* is sealably and slidably arranged in bore 38*c* for reciprocating movement therein between inlet ports 38*a* and 38*b*. The outlet port 38*d* is connected to conduit 15*a* which in turn is connected to a closing chamber 17*c* of blowout preventer housing 17*a* (FIG. 3).

In normal operations, blowout preventer operating fluid enters chamber 17*c* and forces wedge-shaped piston member 17*d* upwardly, deforming torus-shaped packing element 17*e* into sealing contact with drill pipe 20 and closes off the bore of the blowout preventer surrounding the drill pipe. Fluid in an opening chamber 17*b* above the piston member is forced out through opening conduit 16 and through control panel 14 to a reservoir or sump in the remote power unit 11.

Should a malfunction occur in the system, whereby the BOP cannot be closed, as e.g. closing operating fluid pressure cannot be applied to chamber 17*c* to close the blowout preventer, the independent BOP closing system is operated to exert fluid pressure from source 31 on piston member 17*d* through conduit 32, inlet port 38*b* of shuttle valve 38 and conduit 15*a* and to ensure drainage of opening chamber 17*b* through opening conduit 16 and drain conduit 40. The independent power fluid entering port 38*b* causes shuttle valve member 38*e* to move in the bore 38*c* to the position shown in dotted lines in FIG. 2 and close off inlet port 38*a*. Emergency operating power fluid is now exerted through bore 38*c*, outlet port 38*d*, conduit 15*a* and into closing chamber 17*c* causing the piston member 17*d* to move upwardly and cause packing element 17*e* to close around drill pipe 20. As piston 17*d* moves up, hydraulic fluid in opening chamber 17*b* is forced out through conduit 16 and drain conduit 40.

A stepwise procedure for operating the independent closing system unit is provided so as to prevent accidental closure of the blowout preventer. Although a four-step procedure is provided, a three-step or a two-step procedure may be used. The purpose of the emergency closing system is to direct independent power fluid to shuttle valve 38 and to ensure that hydraulic fluid is released or drains from opening chamber 17*b*. The procedure for operating the emergency closing system is as follows:

1. Open normally closed drain valve 40*a* in conduit 40 to drain hydraulic fluid from opening chamber 17*b* and conduit 16.
2. Close drain valve 34*b* in power fluid conduit 32.
3. Open normally closed valve 35 in conduit 32.
4. Screw down on regulator 33 to allow power fluid from source 31 to flow through conduit 32 to shuttle valve 38.

In a three-step operation drain valve 34*b* and step 2 would be omitted. Additionally, in a two-step operation either valve 35 and step 3 or the regulator and step 4 would be omitted.

Although only one nitrogen bottle is illustrated, two are preferred, each supplying, for example, 2,340 psi pressure nitrogen to the conduit 32. That arrangement will close a 10″ annular blowout preventer of the type illustrated in less than 20 seconds.

Figure 4:
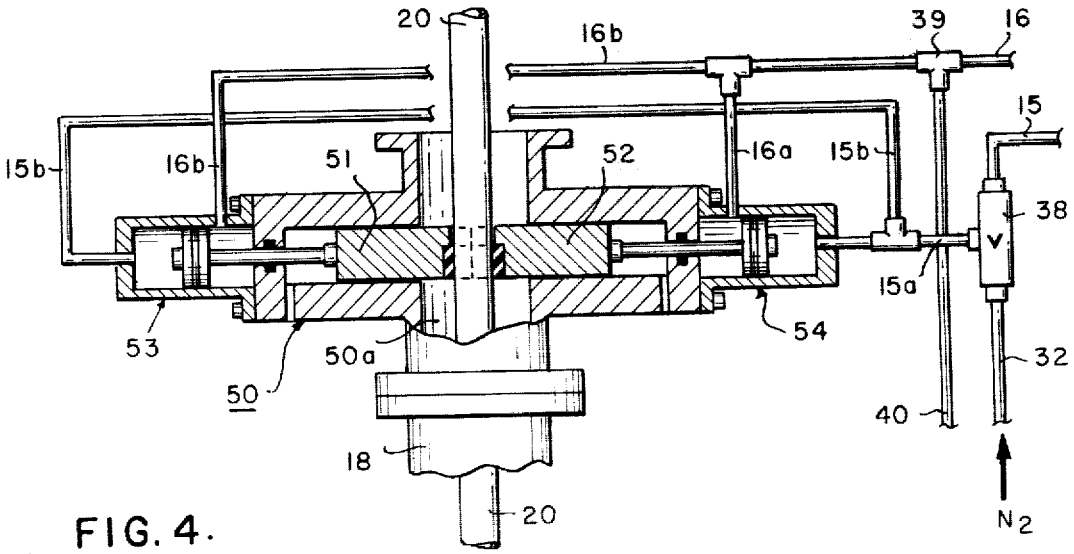
FIG. 4 is a schematic showing a part of the structure of a ram-type blowout preventer.

Although the blowout preventer 17 as shown is an annular type using a doughnut shaped deformable packing element, the emergency closing system may be connected into other types of blowout preventers such as depicted in FIG. 4. A ram-type preventer 50 has a center bore 50*a* through which a pipe string 20 extends. A pair of oppositely disposed rams 51 and 52 are slidably arranged in the preventer housing. The rams 51 and 52 are extended and retracted by piston and cylinder assemblies 53 and 54 to close or open the bore 50*a* around the pipe 20. Shuttle valve 38 as previously described connects to closing conduit 15 and also closing conduit 32. The outlet of shuttle valve 38 is connected by conduits 15*a* and 15*b* to the closing chambers of the assemblies 54 and 53 while the opening conduit 16 is connected by branch conduits 16*a* and 16*b* to the opening chambers of assemblies 54 and 53. This embodiment of the invention operates in the same manner as the blowout preventer 17 operates.

Other three-way type valves may be used in place of the fluid operable shuttle valve shown and described. Also, pressurized gases other than nitrogen may be used as the independent BOP operating fluid. Other changes and modifications may be made in the illustrated embodiments of the invention shown and described herein without departing from the scope of the invention as defined in the appended claims.

I claim:

1. In a control system for blowout preventers used in well operations including a blowout preventer having at least one opening pressure chamber to which fluid pressure is applied to open said blowout preventer and at least one closing pressure chamber to which fluid pressure is applied to close said blowout preventer, one blowout preventer operating power fluid pressure source and an opening conduit and a first closing conduit connecting said one operating power fluid pressure source to said opening and closing chambers, respectively, the improvement comprising:

a drain conduit connected to said opening conduit capable of draining fluid from said opening chamber;

a valve arranged on said drain conduit controlling flow of fluids through said drain conduit;

a nitrogen gas source of operating power fluid pressure independent of said one power fluid source;

a shuttle valve connected to said first closing conduit having two positions, in one position said shuttle valve connecting said one power fluid source to said closing chamber and in another position connecting said other independent power fluid source to said closing chamber, said shuttle valve being arranged in said closing conduit adjacent said closing pressure chamber; and a second closing conduit connecting said independent power fluid source and said shuttle valve, said second closing conduit having arranged therein in sequence from said independent power fluid source to said shuttle valve a pressure regulator, a normally open drain valve, a normally closed valve and a pressure gauge, said pressure regulator and said valves and said drain conduit being located adjacent said independent power fluid source.

* * * * *